US005135625A

United States Patent [19]

Lewy

[11] Patent Number: 5,135,625

[45] Date of Patent: Aug. 4, 1992

[54] METHOD AND APPARATUS FOR POLISHING THE INNER SURFACE OF METALLIC TUBING

[76] Inventor: Michael M. Lewy, R.D. #1, Box 849, Priddle Point Rd., Gloversville, N.Y. 12078

[21] Appl. No.: 797,227

[22] Filed: Nov. 25, 1991

[51] Int. Cl.[5] ..... C25F 3/16; C25F 7/00

[52] U.S. Cl. ..... 204/129.6; 204/275

[58] Field of Search ..... 204/129.6, 129.7, 275

[56] References Cited

U.S. PATENT DOCUMENTS

| | | | |
|---|---|---|---|
| Re. 26,039 | 6/1966 | Johnson | 51/392 |
| 2,848,410 | 8/1958 | Knuth-Winterfeldt et al. | 204/224 M |
| 4,016,394 | 4/1977 | Hecht et al. | 219/61 |
| 4,224,123 | 9/1980 | McLain | 204/212 X |
| 4,270,986 | 6/1981 | Smith | 204/141.5 |
| 4,431,501 | 2/1984 | Leppanen | 204/271 X |
| 4,495,045 | 1/1985 | Jackson | 204/271 X |
| 4,801,367 | 6/1989 | Burgess et al. | 204/224 M |
| 4,882,019 | 11/1989 | Lewy | 204/129.1 |

FOREIGN PATENT DOCUMENTS 0085899 5/1984 Japan .

OTHER PUBLICATIONS

Jumer, John F., "Surface Treatments-Electropolishing", Metal Finishing Guidebook Directory, pp. 420-428, 1988.

"Introducing the New Port-A-Weld Machine", Wheeler Industries product advertisement, 1988.

Die Rohr-Gripzange by Bessey of West Germany product advertisement.

"2600° F. Ceramic tape and Cloth", McMaster Carr Cs. product advertisement.

*Primary Examiner*—T. M. Tufariello

*Attorney, Agent, or Firm*—Heslin & Rothenberg

[57] ABSTRACT

Apparatus and method are disclosed for polishing the inner surface of a metallic tubing. The apparatus includes a container for retaining electrolytic solution and pump means for circulating the electrolytic solution from the container through the metallic tubing to be cleaned. A dc power supply means is provided having a negative terminal which is coupled to a cathode member of a cathode assembly. The assembly also includes a porous material cover over the cathode member. The cathode assembly is sized for insertion within the tubing without completely blocking the flow of electrolytic solution through the tubing. Clamp means is provided for forming electrical connection between the positive terminal of the dc power supply and the metallic tubing to be cleaned. When the clamp means is secured to the metallic tubing and the cathode member is positioned within the tubing, electropolishing occurs on the inner surface of the tubing. Various specific methods are also described based upon the particular cathode assembly configuration used.

10 Claims, 3 Drawing Sheets

METHOD AND APPARATUS FOR POLISHING THE INNER SURFACE OF METALLIC TUBING

BACKGROUND OF THE INVENTION

1. Technical Field

The present invention relates primarily to the cleaning of pipes, and more particularly, to an apparatus and method for electropolishing the inner surface of pipes and metallic tubing.

2. Description of the Prior Art

Today many industries require 100% pure constituents for processes and manufacturing operations, such as in the production of computer chips. In particular, transistor densities on computer chips can reach thousands of devices per square inch, which means even minute amounts of impurities in the constituents can destroy a computer chip under production. One significant source of impurities is often the piping or tubing used to transport constituents during the manufacturing operations. Such tubing is typically made of metallic compounds, which may harbor numerous different types of impurities: such as oxides, metal flakes, dirt, etc. A demand therefore exists for tubing having a highly polished contaminant free inner surface.

Existing methods for cleaning the inner surface area of metallic tubing include flushing and brushing, both of which are labor intensive, requiring significant time and personalized attention to the workpiece. Furthermore, such techniques often result in an inadequate cleaning, especially if the tubing is configured with one or more bends. Bending metallic tubing not only makes brushing and flushing physically more difficult but bending actually generates impurities by creating wrinkles and small flakes in the metal on the inner surface of the workpiece.

As described herein, the present inventive technique utilizes a special electropolishing process to clean the inside of metallic tubing. One system/method for electropolishing pipes is disclosed in U.S. Pat. No. 4,882,019 by Lewy, entitled "Apparatus and Method for Polishing a Plumbing or Electrical Fixture." Briefly, this patent describes the electropolishing of plumbing fixtures for improved solder jointing. In particular, the patent addresses cleaning the outside of a copper pipe and the first several inches of the inside of the pipe to facilitate soldering of the pipes. By way of example, the technique described is particularly useful for facilitating the soldering of pipes within a residential dwelling.

In contrast, the metallic tubing used in many manufacturing processes (e.g., in the manufacture of computer chips) can be ⅛" in diameter and 10' in length. The cleaning of the inner surface area of such tubing creates unique problems which have yet to be adequately addressed. Thus, an improved approach to quickly and efficiently clean the inner surface of tubing shaped in any of various configurations is believed to be commercially significant.

SUMMARY OF THE INVENTION

Briefly described, the present invention comprises in a first aspect a polishing apparatus for cleaning the inner surface of metallic tubing. This apparatus includes a container for retaining an electrolytic solution and pump means for circulating the electrolytic solution from the container through the metallic tubing to be cleaned. A cathode assembly is also provided having a cathode member with a porous material cover. The cathode assembly is sized for insertion within the tubing without completely blocking the circulation of electrolytic solution through the tubing by the pumping means. The cathode assembly includes coupling means for connecting the cathode member to an electrical power supply. Lastly, clamp means are provided for forming electrical connection to the tubing from the power supply such that an electrical circuit is completed between the power supply, cathode member, electrolytic solution and tubing, whereby electropolishing occurs on the inner surface of the metallic tubing. Various embodiments of the cathode assembly are described and claimed.

In another aspect, a method for polishing the inner surface of a metallic tubing is provided. The method includes the steps of: circulating electrolytic solution through the tubing; inserting a cathode assembly having a cathode member with a porous material covering into the tubing, the assembly being sized for insertion within the tubing without completely blocking the flow of electrolytic solution through the tubing; and applying an electrical difference between the cathode member and the metallic tubing such that electropolishing occurs on the inner surface of the metallic tubing. Various specific implementations of the method are also described based upon the cathode assembly configuration used.

The polishing technique embodied by the apparatus and method set forth herein allows for quick and efficient cleaning of the inner surface of metallic tubing. The technique is commercially significant for those manufacturing processes requiring the delivery of pure process constituents. Further, the technique can concentrate surface cleaning efforts on problems areas such as bends in the metallic tubing to be used to deliver the pure constituents.

BRIEF DESCRIPTION OF THE DRAWINGS

These and other objects, advantages and features of the present invention will be more readily understood from the following detailed description when considered in conjunction with the accompanying drawings in which.

DETAILED DESCRIPTION OF THE INVENTION

Reference now is made to the drawings in which the same reference numbers are used throughout the different Figures to designate the same or similar components.

Major components of a principal embodiment of the apparatus of the present invention include a cathode assembly, container for holding electrolytic solution, a pump, a power supply and a clamp for electrically connecting a section of tubing to be cleaned to the power supply. Such an embodiment is depicted in detail in FIG. 1 and more specifically described below.

As shown, a container 10 is utilized to retain an electrolytic solution 11. The container may consist of any electrochemically inert material, an example being polyethylene. Container 10 need not have any particular shape, but may require a certain size as discussed herein.

Electrolytic solution 11 is any electrolytic substance in solution known to react with the particular metal to be polished. An article entitled "Surface Treatments—Electropolishing" by John F. Jumer, which appears in the January, 1988 *Metal Finishinq Guidebook Directory,* pp. 420–428, published by Metals and Plastics Publications, Inc. of Hackensack, N.J. gives examples of electrolytic solutions suitable to electropolish various metals and is hereby incorporated herein by reference. Once a suitable electrolytic solution is chosen for electropolishing it is believed to have an almost unlimited life. The electrolytic solution need be replaced only as a result of drag out and must be occasionally filtered to remove debris.

An example of a suitable electrolytic solution for electropolishing copper tubing is a mixture of 75% phosphoric acid and 25% "Electro-Glo 200", a commonly available substance marketed by Electro-Glo Company of Chicago, Ill. This particular electrolytic solution is safe to handle, provides improved polishing characteristics and appears to have a beneficial property of inhibiting reoxidation. However, any electrolytic solution may be utilized without departing from the claims herein below. Furthermore, as an option, the electrolytic solution may be heated (e.g., to a temperature of approximately 160 degrees Fahrenheit) to enhance the electropolishing capability of the solution.

Figure 1:
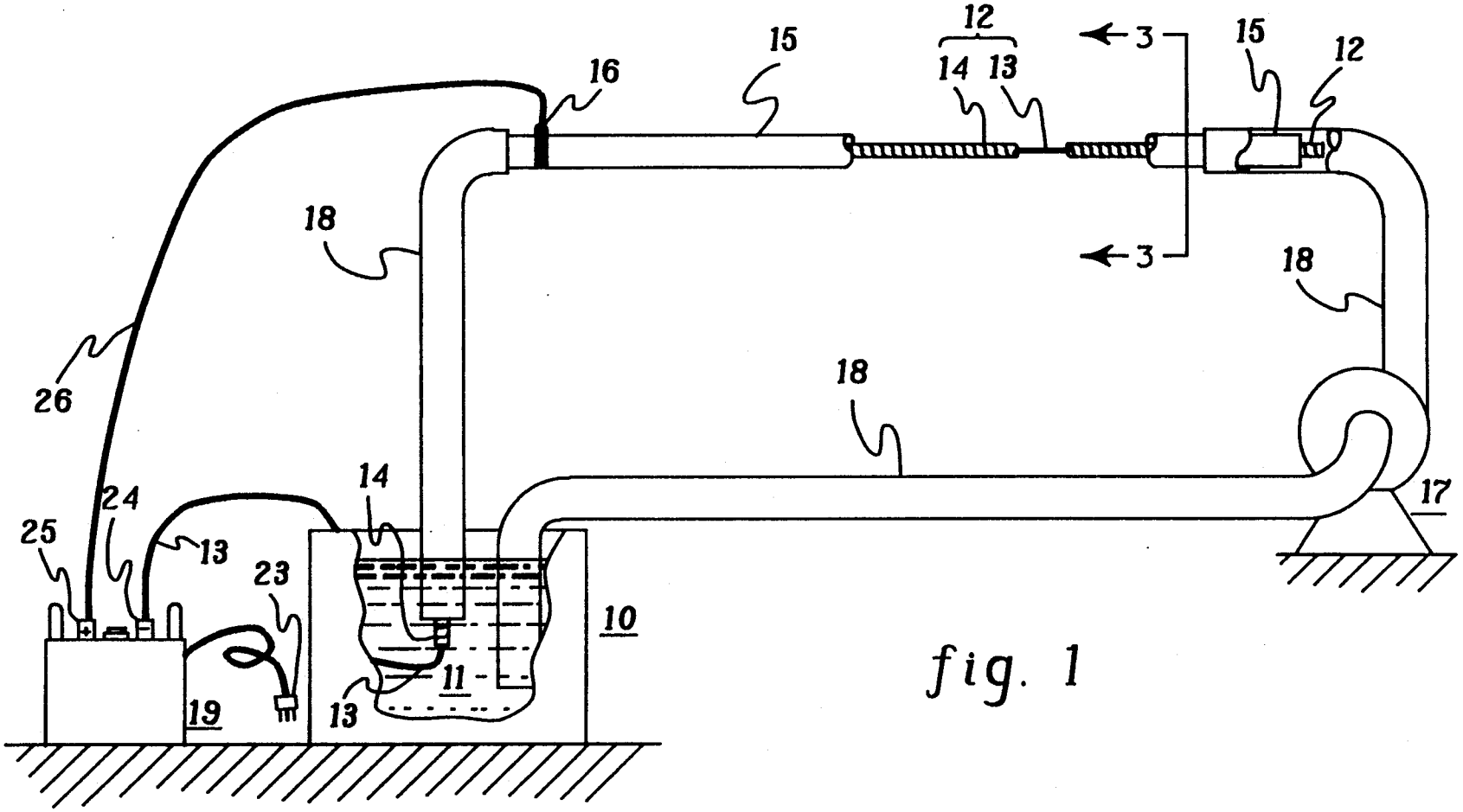
FIG. 1 is a partially cut-away elevational view of one embodiment of the apparatus of the present invention.
Figure 2:
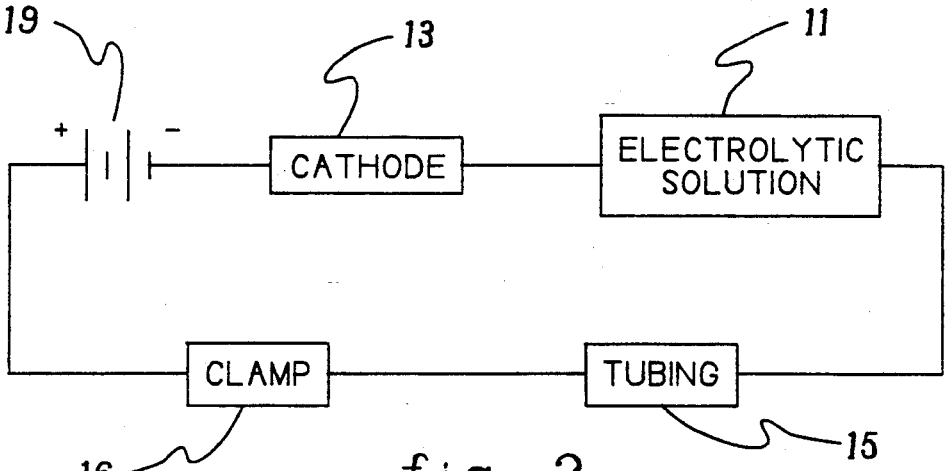
FIG. 2 is a block diagram of an electrical circuit attained using the apparatus and method of the present invention.

As shown in FIG. 2, the electrolytic solution functions to complete an electrical circuit which includes a cathode member 13, a tubing section 15, a clamp assembly 16 and a power supply 19. Each of these components is described further below. Simply immersing the tubing within a tank of electrolytic solution and passing current through the completed circuit will result in an inadequate polishing of the inner surface of the tubing. Electrolytic solution 11 should be circulated through tubing 15 in order for sufficient electropolishing to occur. Circulation of the electrolytic solution insures a complete wetting of the tubing and cathode assembly 12. Furthermore, circulation of solution 11 removes any hydrogen ($H_2$) gas, a by-product of the electropolishing process, which would otherwise form in pockets and shield portions of the inner surface of tubing 15 from contact with the electrolytic solution, thereby effectively shielding the metal from the electropolishing operation. Circulation of electrolytic solution 11 at a low pressure is sufficient to ensure proper wetting of the entire inner surface and $H_2$ gas removal. Any means for circulating fluid may be utilized, examples being bellows, or vacuum and peristaltic pumps. In the embodiment of FIG. 1, a pump 17 is attached to tubing 15 by several hoses 18, which are inert to the chemicals involved. Examples of such materials being vinyl, polypropylene or neoprene.

The electrolytic solution may be circulated back into container 10 via a hose 18 as shown in FIG. 1, or may flow into a separate container (not shown). If the electrolytic solution is returned to container 10, the container must provide a large enough electrolytic solution/atmosphere interface surface to allow $H_2$ gas to dissipate. The size of this container will also depend upon the flow rate of electrolytic solution 11, the amount of electropolishing to be done and the temperature of the electrolytic solution involved.

The particular design of the cathode assembly may vary significantly. As an example of one embodiment, cathode assembly 12 of FIGS. 1 and 3 includes an elongate wire 13 which has a porous covering 14. Wire 13 can vary anywhere from 12 to 22 gauge wire depending upon the size of the metallic tubing to be cleaned and the extent of electropolishing required. Any conductive material, for example copper, titanium or stainless steel, could be used to construct the cathode wire.

Porous material cover 14 must surround cathode wire 13 within the metallic tubing to ensure that wire 13 does not directly contact tubing 15, and thereby create an electrical short. Cover 14 is preferably a very porous material so that electrolytic solution 11 can readily contact cathode wire 13, and thereby produce a flow of electric current between wire 13 and tubing 15 when the components are coupled as described herein. Cover 14 is made of any flexible porous material capable of withstanding the chemicals and temperatures involved in the electrochemical process described. An example of a suitable porous material is a product marketed under the name "Ultra-Temp 391" manufactured by McMaster Carr Company of New Brunswick, N.J.

Figure 3:
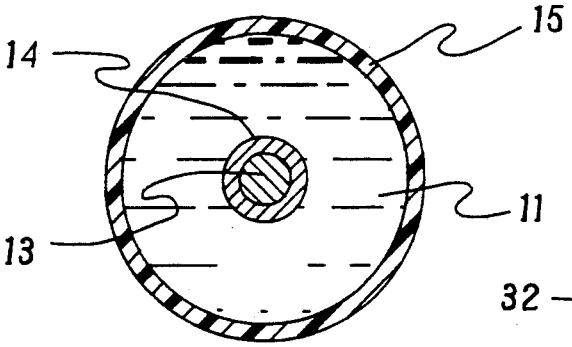
FIG. 3 is a cross-sectional view of a portion of the apparatus shown in FIG. 1 taken along line 3—3.

Cathode assembly 12 (that is, cathode wire 13 together with its porous cover 14) is sized in accordance with the tubing to be polished. For example, in the embodiment of FIGS. 1 & 3, assembly 12 must be long enough to extend the entire length of metallic tubing 15. In addition, as shown in FIG. 3, the diameter of cathode assembly 12 should be small enough so that when the assembly lies within tubing 15, electrolytic solution 11 still flows thereabout to accomplish the above-noted inner surface wetting and hydrogen gas removal functions.

Continuing with the major components of the apparatus of FIG. 1, a dc power supply 19 is shown. Although a dc power supply is preferred, ac electropolishing is possible and the claims appended hereto are intended to encompass such. A power supply capable of cycling the dc electric current, for example for three seconds on and one second off, may be particularly advantageous. Cycling of electric current through the circuit can aid electropolishing by allowing the cathode member to cool and $H_2$ gas to be removed by the circulating electrolytic solution 11. Power supply 19 can comprise any commercially available dc supply means. One preferred supply is manufactured by Wheeler Industries, Ltd. of San Diego, Calif. and is marketed under the trademark "PORT-A-WELD". This power supply operates from a 120 V ac 20 amp standard wall outlet via plug 23. After rectification, it provides 10–100 amps of low voltage dc power across a negative terminal 24 and a positive terminal 25.

The dc power supply 19 is setup such that its positive terminal 25 is electrically connected to tubing 15 and negative terminal 24 is connected to cathode assembly 12. To accomplish this, a simple screw type clamp 16 is used to electrically connect the tubing to a wire 26 which is coupled to positive terminal 25 of dc power supply 19. Any available clamp capable of good electrical connection with the tubing could be utilized in place of screw clamp 16. Cathode wire 13 of assembly 12 is extended to directly connect with negative terminal 24 of the DC power supply means 19. As noted initially, the cathode assembly may be implemented in various embodiments. An example of a second embodiment for the cathode assembly is depicted in FIGS. 4 & 5.

Figure 5:
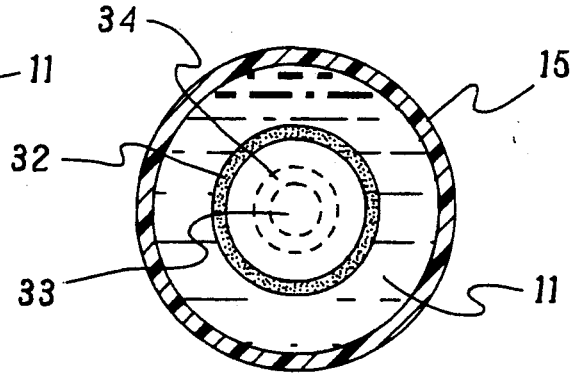
FIG. 5 is a cross-sectional view of a portion of the apparatus shown in FIG. 4 taken along line 5—5.

Referring first to FIG. 5, this embodiment of the cathode assembly, generally denoted 30, includes a cylindrical-shaped slug 31 having a porous cover 32. Slug 31 is electrically connected to a wire 33, which has a non-porous material cover 34. Slug 31 may be manufactured of any one of various conductive materials, examples being lead or titanium. Cover 32 is preferably made of the same material as porous cover 14 discussed above in connection with the cathode assembly embodiment of FIGS. 1 & 3. Slug 31 together with its cover 32 has an outer diameter and length which is determined by the inside diameter of the tubing and the radius of the tightest bend (not shown) in the tubing. The outer diameter should be such that electrolytic solution 11 can flow around the slug and its cover 32, as shown in FIG. 5. Wire 33 may be made of the same material and gauge as cathode wire 13, discussed above. However, unlike cathode wire 13, wire 33 has a non-porous material cover, constructed for example of plastic or teflon. Cathode assembly 30 of FIG. 4 produces a different electropolishing effect than cathode assembly 12 of FIGS. 1 & 3. Specifically, assembly 30 produces an electropolishing action only on the inner surface of tubing 15 in proximity to cathode slug 31, while assembly 12 electropolishes along the entire length of wire 13. Thus, electropolishing of the entire inner surface of tubing 15 using assembly 30 requires that cathode slug 31 be moved throughout the length of tubing 15.

Movement of cathode slug 31 through tubing 15, or even placement of cathode assembly 30 within the tubing, may in some instances require the aid of a leader 36 attached to assembly 30. Leader 36 can be placed within the tubing before any bending might occur. After the tubing is configured to specification, leader 36 is used to pull the cathode assembly 30 through the tubing. Typically, the cathode slug is moved approximately an inch per minute; however, the degree of electropolishing may be varied, since the slower cathode slug 31 is moved through tubing 15 the greater the polishing effect.

Figure 4:
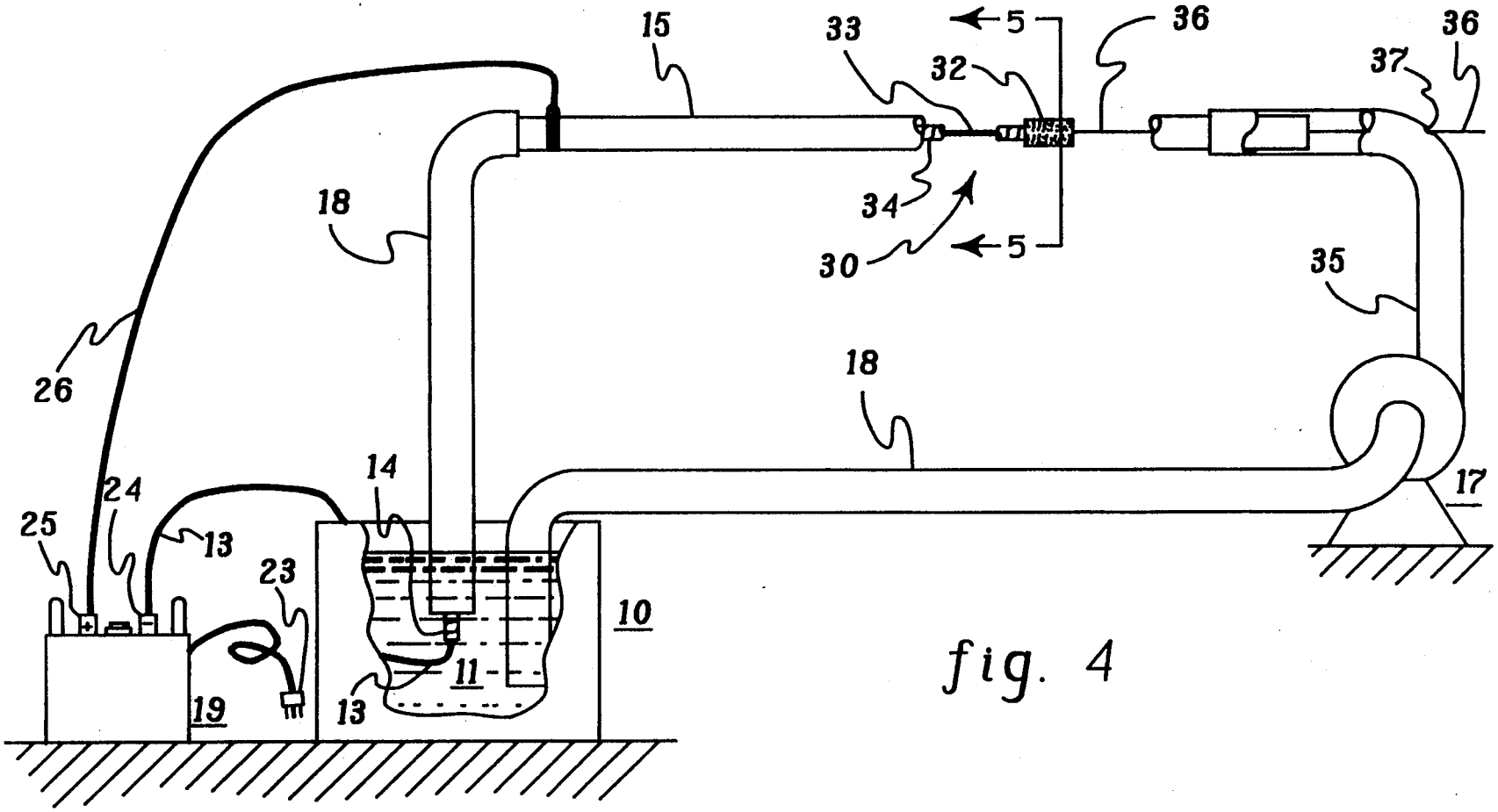
FIG. 4 is a partially cut-away elevational view of a second embodiment of the apparatus of the present invention.

By protruding through a small hole 37 in hose 35 as shown in FIG. 4, leader 36 can be utilized as described to control the electropolishing operation. Although hose 35 has electrolytic solution 11 flowing through it, leakage is minimal due to the self sealing nature of the material of which hose 36 is manufactured and the fact that the electrolytic fluid pressure is low. Leader 36 can be made of any material capable of withstanding the temperatures and chemicals involved, such as nylon, Kevlar or monofilament.

Often it may be desirable to intensify electropolishing in isolated areas of the tubing. As discussed above, the bending of metallic tubing causes wrinkles and metal flakes within the tubing and creates a more difficult surface to clean. Thus, bends often need more cleaning than the balance of the tubing. This can be accomplished by leaving the cathode slug in the area of a bend for a longer period of time during the electropolishing operation. Thus, in order to intensify cleaning in specific areas of the tubing, the location of the cathode slug within the tubing should be known.

Figure 6:
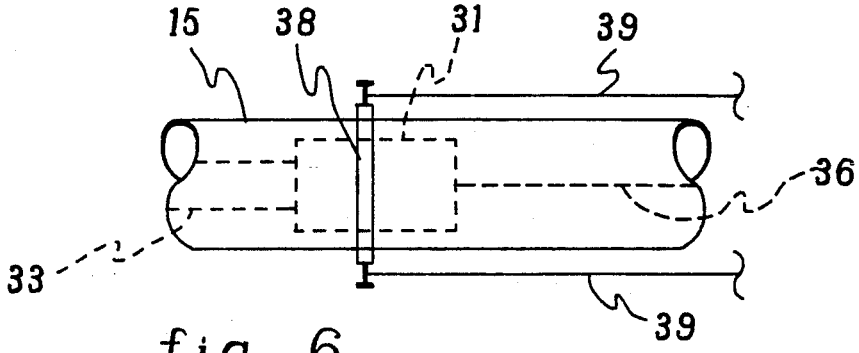
FIG. 6 is a partial elevational view of a section of tubing having an external cathode locator ring pursuant to an aspect of the present invention.

There are numerous ways to track the position of the cathode slug. For example, measuring the amount of leader 36 pulled from hose 35 would provide the location of slug 31, i.e., assuming that the starting position of the slug is known. Another way to track the cathode's position is with the use of an indicator mechanism. As shown in FIG. 6, such a mechanism may consist of an external doughnut 38 and one or more strings 39 outside of tubing 15. When doughnut 38 and cathode slug 31 have identical starting positions, doughnut 38 will indicate the position of the cathode slug 31, i.e., assuming that similar lengths of string 39 and leader 36 are pulled.

The method used for electropolishing metallic tubing varies slightly depending upon the type of cathode employed. A first example is discussed utilizing cathode assembly 12 and with reference to FIG. 1. Assembly 12 is initially inserted into tubing 15 so as to extend its entire length. The tubing is then bent to a specific shape (not shown), i.e., if desired. (Again, the act of bending the tubing will generate impurities by creating wrinkles and small flakes in the metal on the inner surface of the workpiece.) Hoses 18 are connected as shown and electrolytic solution 11 from container 10 is circulated by pump 17 through tubing 15. Cathode wire 13 is electrically connected to the negative terminal 24 of power supply 19 and tubing 15 is electrically connected to the positive terminal 25 via clamp 16. Electrical current from the power supply 19 flows and electropolishing occurs uniformly throughout the entire length of tubing 15. Electropolishing continues so long as current passes through the circuit and the duration of the electropolishing will vary depending on the amount of cleaning desired. After the desired amount of electropolishing has occurred, the electrical current is stopped and clamp 16, cathode assembly 12 and hoses 18 are removed from tubing 15. Tubing 15 is then flushed with a detergent dissolved in water to remove any loose particles on the inner surface of the tubing and to neutralize any acids. A final flush is preferably accomplished with distilled water.

The method for electropolishing the inner surface of tubing 15 using cathode assembly 30 (FIG. 4) varies only slightly. Tubing 15 may initially be bent to a desired configuration or may be configured with leader 36 already inserted therein. Cathode assembly 30 is next placed within the tubing and hoses 18 and 35 are attached. Electrolytic solution 11 is pumped therethrough. Next, clamp 16 is connected and electrical current from DC power supply 19 is passed through the circuit. Since electropolishing occurs only upon the inner surface of tubing 15 in proximity to cathode slug 31, slug 31 is moved through the entire length of tubing 15 by pulling leader 36 through hole 37 in hose 35. Changing the rate at which cathode slug 31 is moved through tubing 15 is used to vary the extent of electropolishing. Once cathode slug 31 has travelled through the entire length of tubing 15, the cathode assembly, hoses and clamp are removed from the tubing. Tubing 15 is then rinsed and flushed with detergent water with a final flushing of distilled water.

It will be observed from the above that the described apparatus and methods fully encompass the advantages set forth. Specifically, a novel apparatus and method are disclosed for quickly and efficiently cleaning the inner surface of metallic tubing. The technique is commercially significant, especially for a manufacturing company requiring pure process constituents. Further, the technique can concentrate surface cleaning efforts on problem areas such as bends in the metallic tubing.

Although several embodiments of the method and apparatus of the present invention have been illustrated in the drawings and described above, the invention is not intended to be limited to the particular embodiments discussed herein. Numerous rearrangements and modifications, which will suggest themselves to those skilled in the art, may be made without departing from the scope of the invention. The following claims are intended to encompass all such modifications.

What is claimed is:

1. Apparatus for polishing the inner surface of metallic tubing, said polishing apparatus comprising:

a container for retaining an electrolytic solution;

pump means for circulating the electrolytic solution from said container through said metallic tubing;

an electrical power supply;

a cathode assembly having a cathode member with a porous material cover, said cathode assembly including means for electrically connecting said cathode member to said power supply, said cathode assembly being sized for insertion within said tubing without completely blocking the circulation of electrolytic solution through said tubing by said pumping means;

clamp means for forming an electrical connection from said power supply to said tubing such that an electrical circuit is completed between said power supply, cathode member, electrolytic solution, and tubing, whereby electropolishing occurs on said inner surface of said metallic tubing.

2. The polishing apparatus of claim 1, wherein said power supply means comprises a dc power supply having a negative terminal and a positive terminal, and wherein said cathode assembly is electrically connected to the negative terminal of said power supply and said tubing is electrically connected to the positive terminal of said power supply.

3. The polishing apparatus of claim 1, wherein the cathode member comprises a wire.

4. The polishing apparatus of claim 3, wherein said wire is substantially equal in length to the length of said metallic tubing to be polished.

5. The polishing apparatus of claim 1, wherein the cathode member comprises a cylindrical-shaped metallic slug sized to pass through said tubing.

6. The polishing apparatus of claim 5, further comprising means for pulling said cathode member through said metallic tubing.

7. The polishing apparatus of claim 1, wherein said container, power supply, cathode assembly and champ means are each readily portable.

8. A method for polishing the inner surface of metallic tubing, said polishing method comprising the steps:

(a) inserting into said tubing a cathode assembly having a cathode member with a porous material covering;

(b) substantially continuously circulating electrolytic solution through said tubing, said assembly being sized for insertion within said tubing without completely blocking the flow of the electrolytic solution through said tubing; and (c) applying an electrical power difference between said cathode member and said metallic tubing such that electropolishing occurs on the inner surface of said metallic tubing.

9. The polishing method of claim 8, wherein said cathode member includes a cylindrical-shaped metal slug, and said method further comprises the step of moving said cathode member through said tubing substantially simultaneous with said steps (b) & (c) to accomplish electropolishing of the inner surface of said tubing.

10. The polishing method of claim 8, further comprising the step of:

bending said metallic tubing into a desired configuration prior to said electrolytic circulating step (b) and said electrical power applying step (c).

* * * * *